US006757572B1

(12) United States Patent
Forest

(10) Patent No.: US 6,757,572 B1
(45) Date of Patent: Jun. 29, 2004

(54) COMPUTERIZED SYSTEM AND METHOD FOR PRACTICING AND INSTRUCTING IN A SPORT AND SOFTWARE FOR SAME

(76) Inventor: Carl A. Forest, 4796 Valhalla Dr., Boulder, CO (US) 80301

( * ) Notice: Subject to any disclaimer, the term of this patent is extended or adjusted under 35 U.S.C. 154(b) by 0 days.

(21) Appl. No.: 09/624,881

(22) Filed: Jul. 24, 2000

(51) Int. Cl.[7] ..... G06F 17/00; A63B 69/36

(52) U.S. Cl. ..... 700/90; 473/131; 473/407; 473/409

(58) Field of Search ..... 463/1, 40–42; 273/317.2, 108.2; 473/131, 407, 409; 700/90–92

(56) References Cited

U.S. PATENT DOCUMENTS 4,220,992 A * 9/1980 Blood et al. ..... 364/410
4,910,677 A * 3/1990 Remedio et al. ..... 364/410
5,294,110 A * 3/1994 Jenkins et al. ..... 273/32 H
5,486,001 A * 1/1996 Baker ..... 273/183.1
5,507,485 A 4/1996 Fisher
5,558,333 A * 9/1996 Kelson et al. ..... 473/131
5,591,088 A * 1/1997 Bianco et al. ..... 473/131
5,681,108 A * 10/1997 Miller ..... 364/411
5,685,786 A 11/1997 Dudley
5,689,431 A 11/1997 Rudow et al.
5,736,960 A 4/1998 Murphy et al.
5,779,566 A * 7/1998 Wilens ..... 473/407
5,797,809 A * 8/1998 Hyuga ..... 473/407
5,810,680 A 9/1998 Lobb et al.
5,878,369 A 3/1999 Rudow et al.
5,949,679 A * 9/1999 Born et al. ..... 364/410.1
RE36,346 E * 10/1999 Germain ..... 364/411.1
6,059,672 A * 5/2000 Zeiner-Gundersen ..... 473/407
6,062,991 A * 5/2000 Moriarty et al. ..... 473/407
6,122,559 A * 9/2000 Bohn ..... 700/91

* cited by examiner

*Primary Examiner*—Teresa Walberg
*Assistant Examiner*—Scott E. Jones
(74) *Attorney, Agent, or Firm*—Patton Boggs LLP

(57) ABSTRACT

A computerized system for instructing a player in an athletic sport includes a screen listing a plurality of discrete physical factors describing a real or hypothetical situation in the sport. A player enters a plurality of personal discrete actions that may be taken in response to the situation. The system selects from memory a corresponding plurality of discrete actions defining an expert response to the situation. The system compares the personal discrete actions and the expert discrete actions and provides expert comments when there are differences. The actual discrete actions taken by the player and the actual results are stored, and this information as well as personal data entered by the player is used by the system in subsequently selecting an expert response adjusted to the particular player.

38 Claims, 8 Drawing Sheets

COMPUTERIZED SYSTEM AND METHOD FOR PRACTICING AND INSTRUCTING IN A SPORT AND SOFTWARE FOR SAME

BACKGROUND OF THE INVENTION

1. Field of the Invention

The invention in general relates to computer systems utilized in practicing and teaching sports, and more particularly to a system that assists a sport participant in making judgements, permits practicing judgement used in a sport during leisure time, and provides coaching while playing a sport or while practicing.

2. Statement of the Problem

It is well-known that computers can be programmed to play board games such as chess or checkers. Such games lend themselves to being played by a computer because such games, while played on a two dimensional board, are essentially uni-dimensional. That is, each move involves only one of a limited number of available moves. Computers have also been used to assist in the playing of sports almost since they were created. For example, computers are used in golf for providing information useful to a golfer, such as tracking location and providing the distance from a pin, keeping track of statistics on shots of particular players, and for providing temperature and weather information. Such systems have also been used to assist in making club selection based on the remaining distance to the pin and past performance, i.e., the distance an individual golfer hits the ball with a given club. See U.S. Pat. No. 5,810,680 issued to Lobb et al. on Sep. 22, 1998, U.S. Pat. No. 5,685,786 issued to Douglas P. Dudley on Nov. 11, 1997, and U.S. Pat. No. 5,507,485 issued to Donald Fisher on Apr. 6, 1996. Club selection, like a move in a board game, is an essentially unidimensional action, since only one of a limited number of alternatives is selected. As indicated above, in prior art golf computer systems club selection is based on one playing factor, i.e., the distance remaining to the pin. In fact, cards or other printed materials which enable a player to select the proper club if the distance to the pin and the average distance each player hits each club are known, have been available to golfers since long before computers were available.

Other computerized golf systems project a picture of a golf course in a driving range type environment, which is supposed to simulate playing on well-known courses. However, since the place from which the ball is hit is always the same, such systems do not simulate actual play any more than a driving range does, and, at most, provide an interesting environment in which to practice golf shots. There are also computerized "simulated" golf games, football games, baseball games etc. of the market, in which the "player" uses a joystick like device to "drive" a simulated golf ball along a simulated golf course displayed on a computer screen, move "football players on a simulated football field displayed on a computer screen, "swing a bat", "run bases", and "catch a "ball" on a simulated baseball diamond, etc. Such "games" have little to do with the actual sport that is "simulated", since the physical movements used in manipulating a joy stick have no relation to the physical movements of swinging a golf club, throwing a football, hitting a baseball etc. And since the physical situation is very much different than the actual sport, judgements uses in playing such games can actually teach away from appropriate athletic skills.

Thus, although computers have been available and used in athletic sport environments for nearly a generation and the numbers of participants in athletic sports, such as golf and tennis, have grown greatly in that generation, computers have yet to be utilized in a manner that facilitates the learning and playing of an athletic sport beyond what is available without computers.

3. Solution to the Problem

The invention solves the above problem by recognizing that every athletic sport includes both a physical coordination aspect and a judgmental, or mental aspect. It recognizes further that each aspect can best be learned only by performing that aspect.

The invention solves the above problem by not attempting to simulate the physical coordination aspects of a sport, since these can best be learned by actually performing the sport. However, the invention recognizes that the mental aspect of many sports can be isolated from the physical coordination aspect and practiced separately. The invention recognizes further, that while the physical coordination aspect of a sport can be practiced best only with the full accouterments of the sport, the mental aspects primarily involve judgements that can be practiced effectively in compact and efficient settings.

The invention provides a system for isolating the mental aspect of an athletic sport from the physical aspect so that the mental aspect can be practiced when the full physical accouterments of the sport are not available.

The invention provides a compact system for advising and instructing a player of a sport in the judgement aspects of the sport.

The invention also provides a compact system with which a player of a sport can receive advice and instruction on the judgement aspects of the sport from an expert in the sport.

The system solves the above problems by analyzing an athletic sport into: a plurality of discrete physical factors that together describe a real or hypothetical situation that may arise in the sport; and a plurality of discrete actions that together describe an appropriate response to the real or hypothetical situation. It is important that the physical factors and actions be discrete, at least at some level.

The system provides a screen that either presents a set of physical factors that describe a hypothetical situation or allows the player to enter a set of physical factors that describe a real situation in the sport. The player can enter a set of actions responsive to the physical factors, which actions together describe a trial response to the situation. The system presents a set of actions that together describe an appropriate or expert response to the situation.

Prior to using the system, the player can enter personal data regarding the player. The system will then adjust the appropriate response to the player. For example, if the sport is golf, in deep rough, the system will suggest one type of shot for a large, strong, and aggressive player and another type of shot for a diminutive player. The player can also chose to have the system provide advice that will result in the lowest score over the short term, i.e., adjust for the abilities of the player, or provide advice that will force the player to learn and improve in his or her ability in the sport. For example, if the sport is golf and the player consistently slices with a particular club that is appropriate for a shot, the system will suggest aiming to the right (for a right handed player) if the system is set to optimize the short-term score, but will suggest a proper grip and stance that should be learned to avoid a slice if the system is set for player to learn and improve.

The user can compare his or her response to the suggested response of the system and thus learn appropriate responses.

If the player desires, the player can select one or more well-known experts or pros and the system will provide the responses these one or more experts would make to the situation. The player's choice of expert can be different for different areas of the sport. For example, if the sport is golf, an expert that is particularly good in the short game can be selected for the shorter range shots, and an expert that is good at hitting fairways can be selected for longer range shots. The player can interact with the system or an expert or pro to discuss the difference between the player's trial response and the expert's response and/or to have the system or expert explain particular actions that the system or expert suggested.

The system also can provide an expert on-line to review the player's responses and/or to respond to questions of the player about particular actions.

The system also provides pictures and/or video's that illustrate a particular suggested action. The player can zoom in on various portions of the picture and/or video that the player desires to examine more closely. For example, by selecting a discrete action called "stance", the player can zoom in on the feet of an expert golfer demonstrating a pitch shot to examine the expert's stance during this shot. By selecting different experts from a pull-down menu, the player can do this with several experts to compare the expert's stances for this shot.

The player can customize the system by entering the player's own tips and reminders for each physical factor, each general action, specific physical factors specific actions, and combinations thereof.

The computerized system according to the invention not only provides a system that can be utilized on a computer when not actually participating in a sport to practice judgmental aspects of the sport, and can be utilized in teaching the sport in an instructional setting, but also can be used while participating in the sport to assist in making judgements as to what actions should be taken. For example, an embodiment of the system specialized for the game of golf, can be used when not actually on the golf course to practice club selection, shot selection, swing selection and other golfing judgements, can be utilized in teaching the game of golf in an instructional setting, and also can be used on the golf course to assist in making judgments as to what golfing actions should be taken. Numerous other features, objects and advantages of the invention will become apparent from the following description when read in conjunction with the accompanying drawings.

DESCRIPTION OF THE PREFERRED EMBODIMENT

1. Overview

Figure 1:
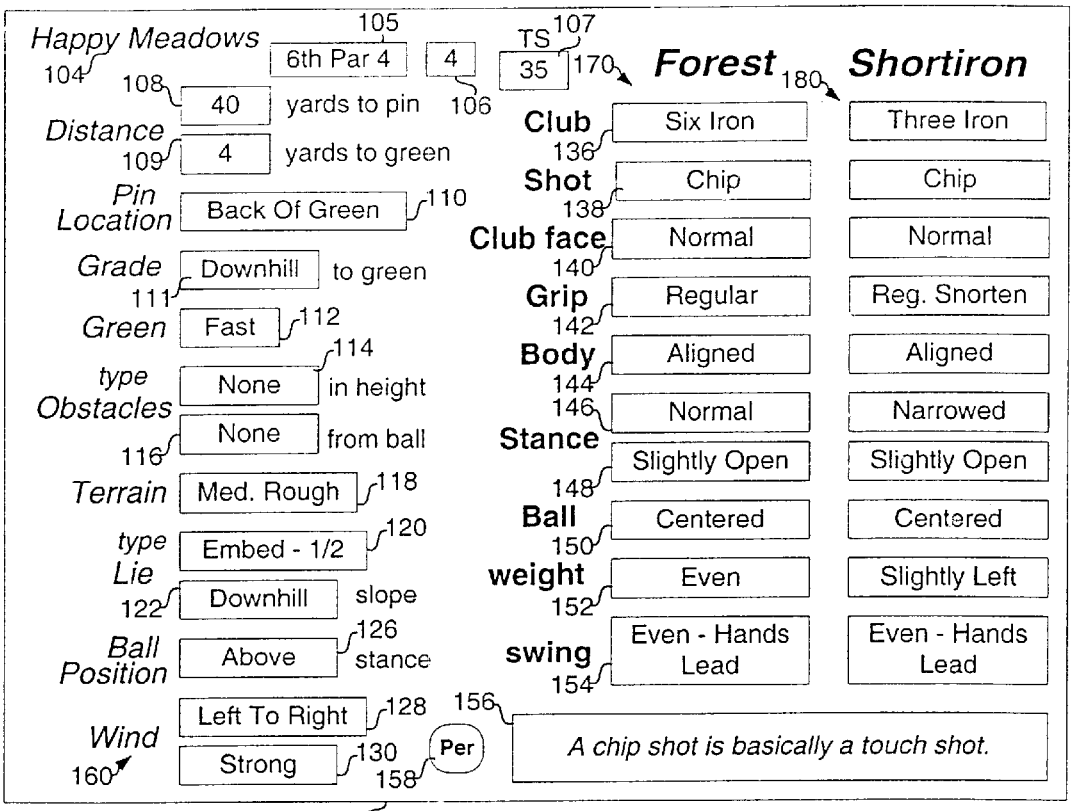
FIG. 1 shows a preferred embodiment of a screen of a display which forms a part of the system according to the invention, which screen may be utilized to input a plurality of discrete physical factors which describe a real or hypothetical sporting situation, and on which discrete actions may be selected by practitioner of the sport to practice responding to the situation.

FIGS. 1 represents a screen 100 on a display of a system according to the invention. The screen 100 may be a the display of a personal computer, the display of a television set, the display of a hand held portable computer, the display of a cellular telephone, or any other such display that communicates with an electronic processor. For this screen and most others discussed herein, if the display is a small one, such as in a hand-held computer or a cellular phone, then only a portion of the screen will generally be visible at one time, and the other portions may be viewed using a scroll or other screen control device. The screens 100, 200, 300, 400, 622, 722, 823, 840, 850 shown in the drawings are not intended to be precise and complete reproductions of actual screens used in a product using the invention, but rather are representations of such screens that illustrate the features of the invention in a simplified manner that makes it easier to focus on the inventive aspects of the system according to the invention. Likewise, the various electronic devices shown in the drawings, such as the cell phone 600 (FIG. 6) and the hand-held computer 700 (FIG. 7) are not meant to be precise and complete reproductions of such instruments, but rather are simplified representations that permit focusing on the inventive aspects of the devices.

The invention will be described using the sport of golf, although the system can also be used in the sports of tennis, hockey, rock climbing, skiing, or any other sport which requires judgement in performing actions in response to a physical situation.

Screen 100 includes a data entry column 160 in which physical factors 108, 109, 110, 111, 112, 114, 116, 118, 120, 122, 126, 128, and 130 describing a real or hypothetical situation that may arise in playing the game of golf can be entered, a data entry column 170 in which specific actions 136, 138, 140, 142, 144, 146, 148, 150, 152, and 154 responsive to the physical situation described in column 160 are entered by the user of the invention, and column 180 in which the system displays appropriate actions corresponding to the actions in column 170 responsive to the physical situation described in column 160. In FIG. 1, the physical situation that has been entered is that the ball is forty yards from the pin and 4 yards from the green, the pin location is towards the back of the green, the general grade is downhill to the green, the green is fast, there are no obstacles between the ball and the green, the terrain is medium rough, the ball is embedded to one-half its diameter in the soil and the slope on which the ball lies is down hill toward the green, the ball is above the position of the golfer when addressing the ball, and the wind is left to right and is strong. The player, Forest, has entered a response that includes the following actions: selecting a six iron; making a chip shot, with the club face normal, the grip regular, the body aligned with the direction to the pin, the stance normal but slightly open, the ball centered in the stance, the player's weight evenly distributed, and the swing even, with hands leading. The golf pro, Shortiron, via the system of the invention, has suggested the same actions except selects a three iron instead of a six iron, suggests a shortened up grip, and slightly more weight on the left foot. What is an appropriate action may, of course, vary from one expert to the next, sol as will be described in more detail below, the user may select the actions of one or a plurality of different experts, which in the game of golf, generally would be golf professionals. The exemplary screen 100 shows the actions responsive to the physical situation shown in column 160 entered by a user or player "Forest" and the appropriate or suggested responses of a fictitious golf professional "Shortiron". Screen 100 also displays the name 104 of the golf course, the hole and par score 105 for the hole on which the physical situation occurs, the number 106 of the current stroke for the hole, i.e. stroke number 4, and the total strokes 107 in the current round, i.e., 35 strokes. As will be discussed in more detail below, the system of the invention stores information about the course that permits the system automatically fill in many of the boxes of column 160, thus shortening the time to use the system. In box 156 the system displays either a personal tip entered by the user or player for the particular physical situation, or a tip from the golf professional selected. Button 158 permits selection of either the personal tip or the professional tip and displays "Per" when the personal tip is displayed and "Pro" when the professionals tip is displayed. In the example of FIG. 1, the user has selected a personal tip, and a reminder, "a chip shot is basically a touch shot", which was previously entered (see FIG. 11) by the user to be displayed whenever a chip shot is a selected or suggested action is displayed.

The preferred method of entering the data in columns 160 and 170 is by use of pull-down menus. For example, when "yards to pin" is selected by tapping with a select tool or clicking a mouse with tne cursor located on the phrase, a pull-down menu appears in and below the box 108 showing various yardages, and the user simply taps the screen or clicks on the appropriate yardage. Likewise, each of the entry boxes 109 etc. in column 160 and 136 etc. in column 170 has a pull down menu of appropriate selections associated with it. The pull down menu for "yards to green" includes not only numbers of the yardage, but also a selection that says "On Green". The pull down menu for the "Obstacle" physical factor first permits the user to select the type of obstacle, such as "sand trap", "water hazard", "tree", "bush", "grass", "rock", "building", etc., then, depending on the obstacle, permits the entry of data specific to that obstacle, such as the height and distance from the ball, which are shown in the figure. Likewise, the "Lie" pull down menu permits the user to select several types of lies, such as "in divot", "embedded", "hard", "soft", etc., and then permits the entry of data specific to the type of lie. Alternatively, a keyboard or other manual entry device can be used to enter the physical factors and actions. Also, a geophysical positioning system (GPS) may be used to enter any of the distance factors, and an electronic course map or description may be used to enter any of the factors that depend solely on ball location. The system automatically enters the suggested actions in column 180 when the pro's name, Shortiron, is tapped or clicked on. The hole in box 160 is selected by tapping or clicking on the middle of the box to select a pull-down menu, or is advanced (incremented) by tapping at the left side of the box, and backed up (decremented) by tapping or clicking on the right side of the box. The distances in boxes 108 and 109 can similarly incremented or decremented.

Figure 2:
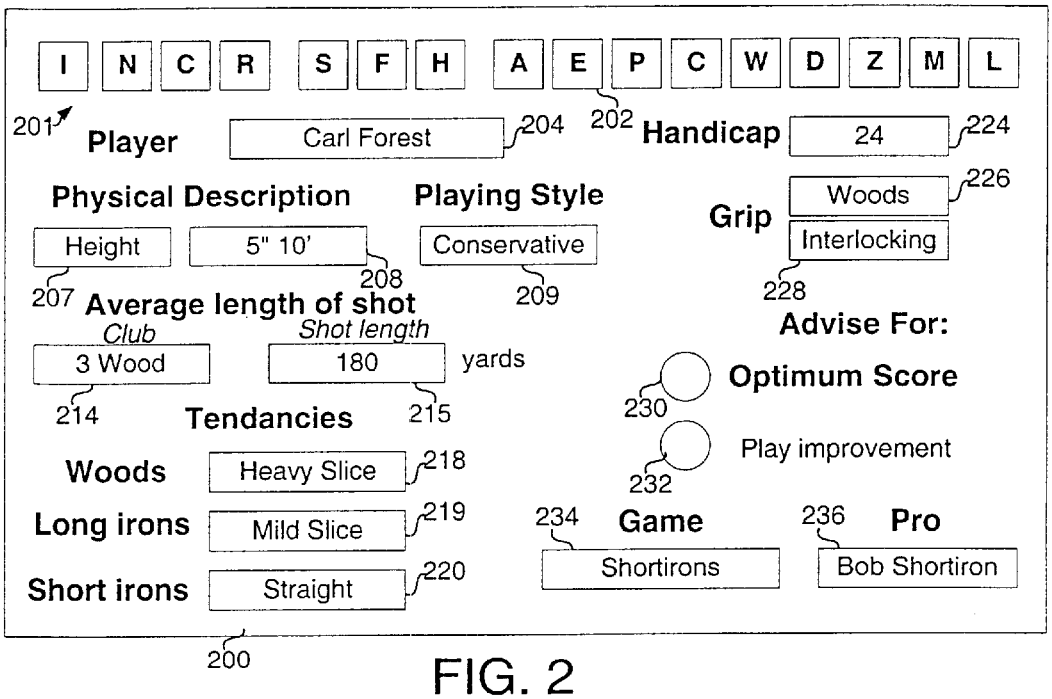
FIG. 2 illustrates a preferred embodiment of a personal data screen which forms a part of the system according to the invention.

Turning now to FIG. 2, the personal data screen 200 is shown. This screen is used to enter personal information about particular users or players. At the top of the screen is a button bar 201 containing 16 different buttons in the embodiment shown. This button bar normally appears at the top of each screen, but for simplicity is shown herein on only the screens of FIGS. 2 and 3. Exemplary functions of the button bar shown will be discussed below. As known in the computer art, the button bar is customizable in that the user can select which buttons are to be shown, the icon on the button, the order and grouping of the buttons, and the position of the button bar on the screen. Selecting entry box 204 activates a pull-down menu, which includes the names of the users for whom data has been entered. If data for the user has not been entered, the new user entry in the pull-down menu is selected, and the name of the new user can then be entered along with his or her personal data. Selecting box 207 activates a pull-down menu that includes physical characteristics such as height, weight, sex, and strength. For each physical characteristic, an appropriate descriptive term can be selected from a pull-down menu in box 208. In the entry shown, height is the physical characteristic selected, and the term "five feet, ten inches" has been selected from the pull-down menu 208. By selecting box 209, the playing style of the user can be selected from a pull-down menu. Using boxes 214 and 215, the average shot length for each club can be entered by selecting the club from a pull-down menu that appears when box 214 is selected, and selecting a length from a pull-down menu that appears when box 215 is selected. Similarly, the users playing tendencies can be described for each of three classes of clubs, woods, long irons and short irons, by the use of pull-down menus 218, 219, 220. The users handicap can be entered via a pull-down menu that is activated by selecting box 224, and the grip the player uses can be described for woods, irons, chip shots, and putting by selecting one of the four categories from a pull-down menu associated with box 226, and then selecting the grip description from a pull-down menu associated with box 228. The user can instruct the system how he or she wants to be coached by selecting one of buttons 230 and 232. The system shows the coaching style that is selected in bold red color, while the non-selected coaching-style is shown in a light gray tone. In FIG. 2, the Optimum Score coaching style has been selected. If the Optimum Score coaching style is selected, the system takes into account the players characteristics, and suggests actions based on those characteristics that will result in an optimum score, forthe immediate game. For instance, if the system knows the user has a heavy slice with woods, it will suggest that the player to select club which will result in quicker progress toward the pin, or instruct the player to aim to the right. If the user selects the Play Improvement coaching style, the system will suggest actions that are appropriate for a person of skill, which will result in the player practicing and/or learning actions generally appropriate to a physical situation. For example, even though the system knows the player tends to slice heavily with woods, the system will suggest woods for long shots, and suggest stances, grips, etc. that cure a slice. Finally, using boxes 234 and 236, the user can select an expert or golf professional to coach him or her for a variety of different portions of the golf game. By selecting box 234, a pull-down menu appears showing various "game" portions of the sport of golf, such as the short iron game, the long iron game, the putting game, and the driving game. Then, for each "game" the user can select a professional from a pull-down menu that appears when box 236 is selected. The name of the professional selected then appears above column 180 on screen 100 and the suggested actions in column 180 are those that the selected professional has provided.

Figure 3:
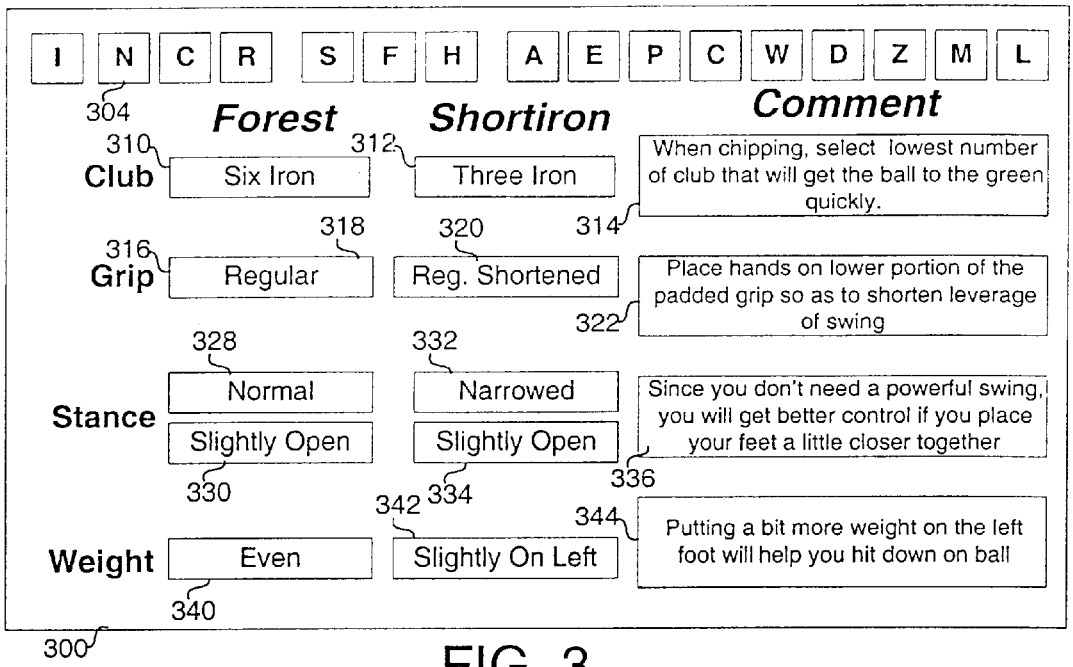
FIG. 3 shows a preferred embodiment of an instructional screen which forms a part of the system according to the invention.
Figure 4:
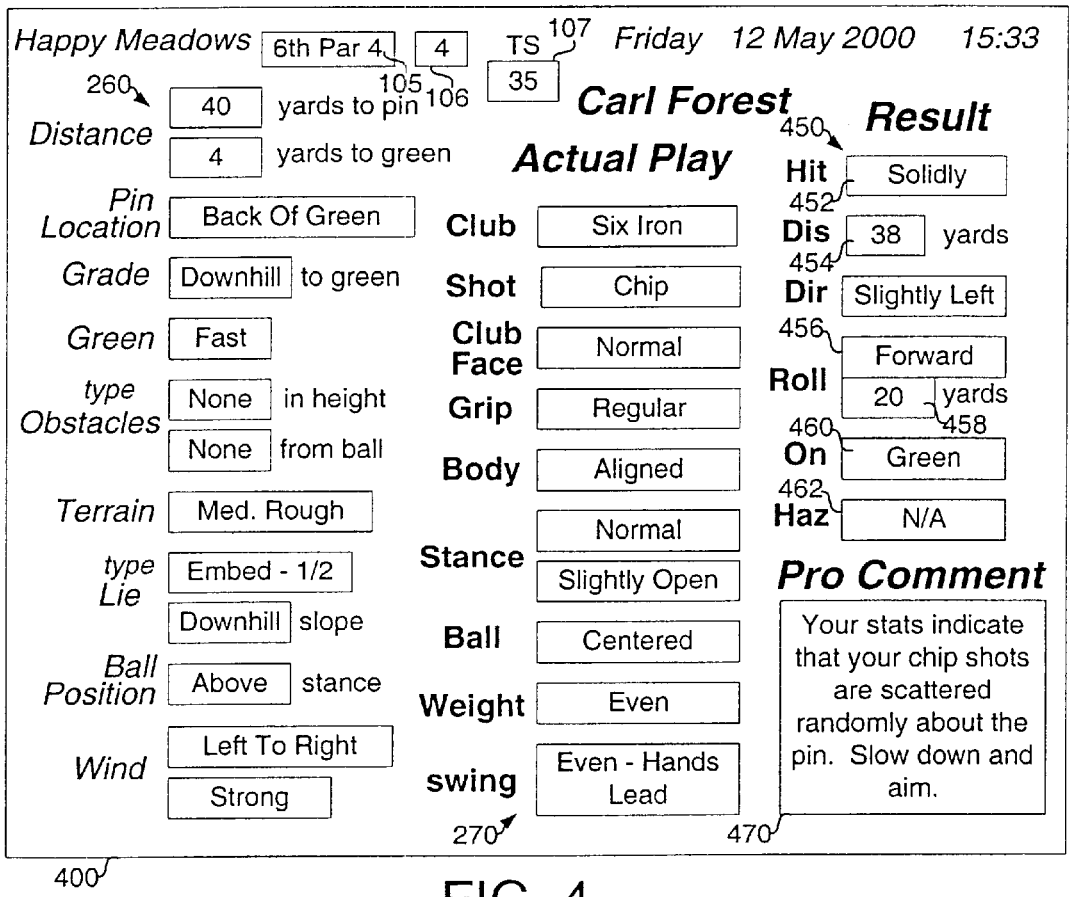
FIG. 4 shows a preferred embodiment of a play-result screen with professional comment according to the invention.
Figure 6:
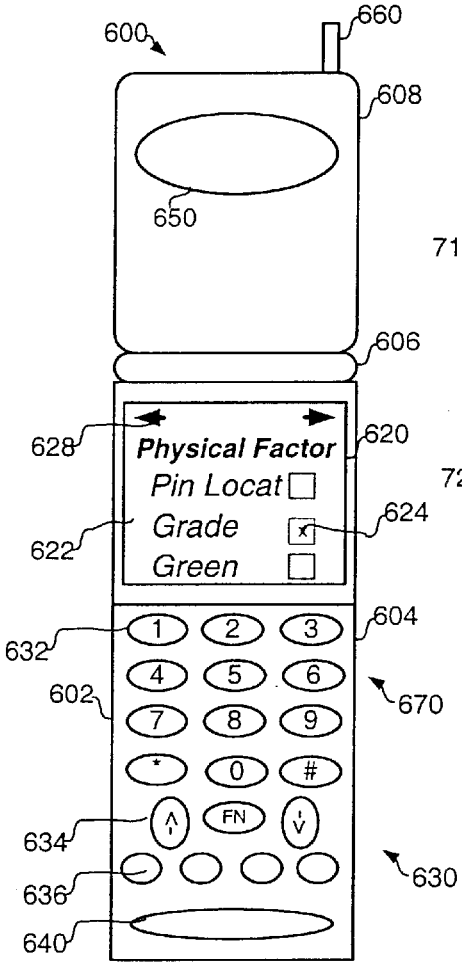
FIG. 6 illustrates a cellular phone according to the invention on which a sport may be practiced and instruction can take place showing a portion of the set-up screen.
Figure 7:
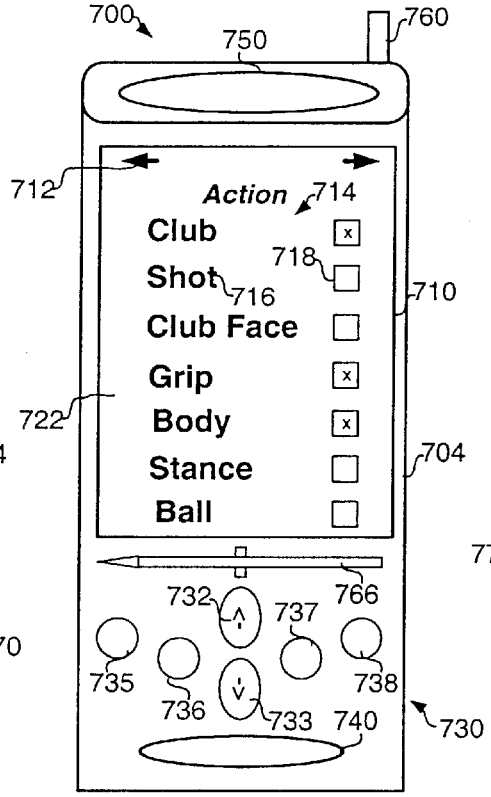
FIG. 7 is a plan view of a hand-held portable computer/communication device according to the invention on which a sport may be practiced and instruction can take place showing another portion of the set-up screen.
Figure 8:
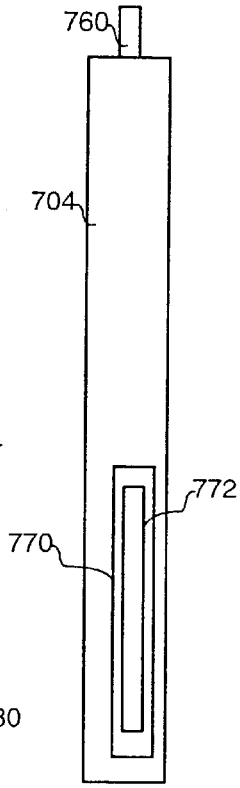
FIG. 8 is a right side view of the device of FIG. 7.
Figure 9:
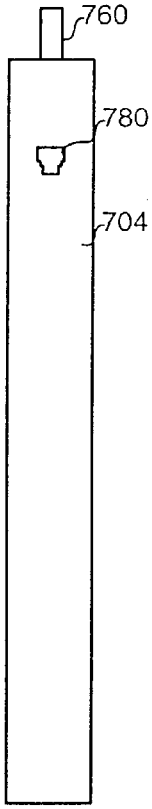
FIG. 9 is a left side view of the device of FIG. 7.
Figure 11:
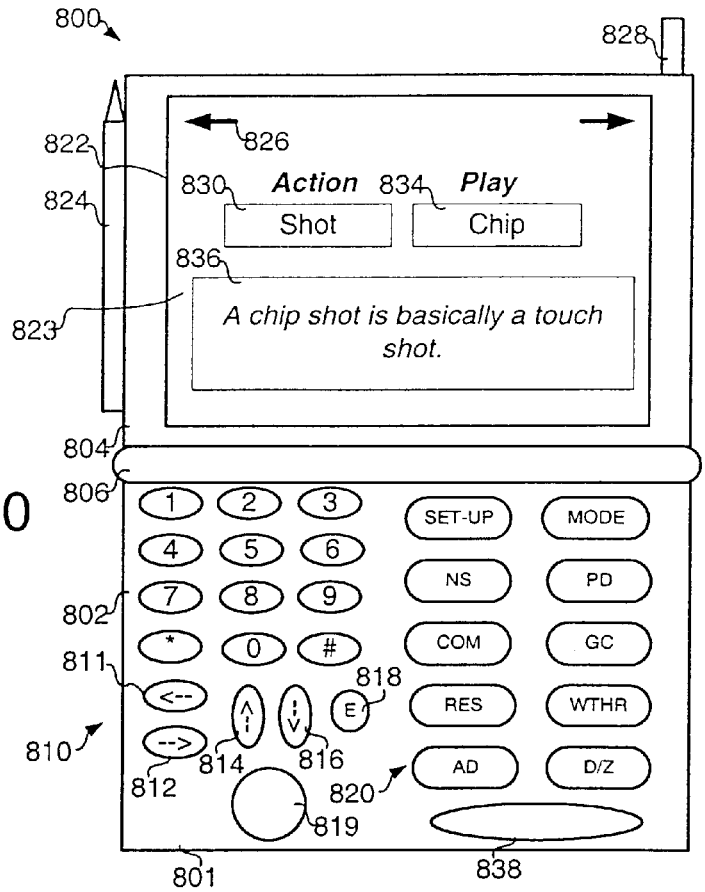
FIG. 11 illustrates a dedicated computer apparatus according to the invention showing the personal tip entry screen.

The button bar 201 provides short cuts to utility functions as well as many of the features of the system according to the invention. Selection of a button, such as 202, either opens one of the screens discussed herein or opens a pull-down menu that invites the user to make a selection of a function or a feature of the invention. Each button, such as 202, has an icon on it that suggests the function or feature it makes accessible. For purposes of this disclosure, the icon is shown as a letter because that is simpler to represent within the constraints of patent drawings; however, in the actual system, the icons-are more complex and intuitive. Starting from the left most button, the button with an "|" on it opens the initial setup screen, portions of which are shown in FIGS. 6, 7, and 11 which shall be discussed below. The button with an "N" on it opens a pull-down menu that permits accessing either a new or previous physical situation-action screens such as shown in FIG. 1 and discussed above. The button with a "C" on it accesses a pull-down menu that in turn accesses a current and saved comment screens, and exemplary one of which is shown in FIG. 3, and will be discussed below. The button with and "R" on it opens a pull-down menu that permits the accessing of results screens such as shown in FIG. 4. This is may be a results screen associated with the current physical situation-action screen, a previous results screen from the round being played, or a results screen saved in a previous round. In Study Mode (see below), it opens a results screen version that permits the user to quickly enter actions in response to physical situations entered by the system or by the user and see what kind of results might occur if the entered actions were taken in response to the physical situation.

The "S", "F", and "H" buttons are set off from the other buttons because the related to utility functions. The "S" button permits the user to save a screen. Selecting it opens a pull-down menu that assigns a default file name for the screen, and permits the user to override the default file name. Selecting the "F" button permits the user to find a previously saved screen. Selecting the "H" button permits the user to access the help function.

The right-hand set of buttons access various features of the invention. The "A" button accesses a pull-down menu that permits the user to change the "Advise For" function as described above in connection with buttons 230 and 232. Selecting the "E" button accesses a pull-down menu that permits the user to indicate that he or she is ready for the system to suggest actions, or change the expert or pro-selection. Selecting the "P" button opens a pull down menu that permits the user to open a personal data screen such as screen 200 in FIG. 2. The user is invited to select either a new personal data screen or a personal data screen saved previously. The "C" button in this section opens a pull-down menu that permits the user to select the golf course on which the user is playing in Play Mode or as the simulated course in Simulation Mode (see below). A submenu of the course menu permits the player to select a particular hole on the selected golf course, though this is generally selected with box 105 on screen 100 (FIG. 1). The "W" button accesses a pull-down menu that permits the user to describe the weather. This can be the actual weather in Play Mode, or simulated weather in Practice, Simulation, and Study Modes. Selecting the "D" button while an action on any of screens 100, 200, or 400 is highlighted initiates a video display of that action as demonstrated by the selected pro. Selecting the "Z" button accesses a zoom icon that permits the user to zoom in on the portion of the display on which a zooming cursor is located. Selecting the "M" button accesses a mode pull-down menu that permits the user to select between Play (FIG. 16), Practice (FIG. 17), Professional (FIG. 18), Simulated (FIG. 19), or Study Mode. In Play Mode the system of the invention interacts with the user in a manner appropriate for a user who is actually playing a game of golf while using the system. In this mode, electronic assistance, such as described below, when available, is used to quickly fill in physical situation data on the screen 100. In addition, abbreviated physical situation screens as selected in the set up mode and prompts are used so that the user does not hold up play while using the system. In the Practice Mode, the system fills in the physical situation column 160. In the Professional Mode, real-time professional assistance is provided. In the Simulated Mode, a screen is provided which shows a picture of the physical situation, and when the action is selected, a ball moves on the screen in a trajectory that illustrates the result. In Study Mode, the results screen 400 is primarily used. This Mode provides a shortened and focused version of the practice mode to study that manner in which results change with different actions. In this mode, the user fills in trial responses in column 170, and the system immediately provides the projected result in column 450. Selecting the "L" button accesses a locator pull down menu that permits the entry of data using a locator system, such as a GPS system, as discussed below.

In its simplest form, the software system according to the invention is intended to be sold in a software package in which no expert or golf professional is provided. In this simple system, the phrase "Suggested Play" is substituted for the professional's name at the top of column 180, and when this phrase is clicked on or otherwise selected, the system provides suggested actions in column 180. The user can buy an accessory software package that includes suggestions by a specific expert, or multiple-expert packages that include a suggestions by a plurality of experts. When one or more expert packages are installed in the system, the ability to select experts via the personal data screen (200 FIG. 2) or the expert button "E" is activated.

Turning now to FIG. 3, the comment screen 300 is shown. This screen allows the user to evaluate differences between his or her selected actions on screen 100 and the pro's suggested actions. When this screen is accessed from a physical situation-action screen 100, it displays both the user's selected action and the pro's suggested action for each action for which there is a difference between the selected action and the suggested action. It also provides comments from the pro that explain why the suggested action was suggested. The comment screen example 300 shown in FIG. 3 illustrates a comment screen activated from the exemplary physical situation-action screen of FIG. 1. In the screen of FIG. 1, the "club", "grip", "stance", and "weight" actions selected by the user are displayed in boxes 310, 316, 328 and 330, and 340, respectively, while the actions suggested by the selected pro, Shortiron, are displayed in 312, 320, 332 and 334, and 342, respectively, since these entries show different actions in FIG. 1. A comment box, 314, 322, 336, and 344, respectively, displays the pro's comments for each of the "club", "grip", "stance", and "weight" actions, respectively. The comment screen can also be accessed from screens other than the physical situation-action screen, and, as a default, will show the comments related to the most recently completed physical situation-action screen. Any comment screen can be saved and accessed via the pull-down menu associated with the comment button, 305.

FIG. 4 shows an exemplary results screen 400. Columns 260 and 270 have been discussed above in connection with FIG. 1. This screen may or may not be used. That is, the user has already been instructed prior to the results screen. The principal use of the results screen in the Play Mode is to collect data on the user. This data is then integrated by the system for use in making future suggestions and is available to the user to study his or her game. It can also be used by the player subsequently to study a round of golf or to review a round with a professional. In the Practice, Simulation and Study modes, the results are entered by the system. When a user has entered a set of actions 270 and either played a shot using these actions in the Play Mode, or decided to play the shot and see the simulated results in the Practice, Simulation, and Study Modes, the user selects the results button on the button bar. This saves the physical situation-action screen and brings up the results screen. If in Play Mode, the user can then enter the results in column 450. In the exemplary screen 400, the results screen has been entered from the exemplary physical situation-action screen 100 of FIG. 1 and the user has entered the results that the shot was hit solidly, the ball traveled approximately 38 yards, the direction was slightly left of the pin, the ball rolled about 20 yards in the forward direction after hitting the ground, the ball ended up on the green, and no hazards were encountered in boxes 452, 454, 455, 456, 458, 460, and 462, respectively. The results are preferably entered by selecting a box and utilizing a pull-down menu to select the appropriate result. If a GPS system is available, the data in boxes 454, 455, and 460 may be entered using the "G" button. To do this, the system is placed at the position from which the ball was hit and the "Initial Position" entry is selected, then the system is placed at the position the ball ends up and the "final position" entry is selected. If the GPS system has been used to determine the location of the ball, i.e., the entries in boxes 108 and 109 of the physical-situation action screen 100, then the initial position has already been entered and only the final position needs be entered. The distances may also be entered manually. After the results have been entered, a comment from the selected pro appears in box 470. This comment may relate to any of the items on the results screen or combinations thereof. The date and time the result was entered is shown at the upper left of the results screen. This becomes part of the record of the shot when the screen is saved.

Figure 5:
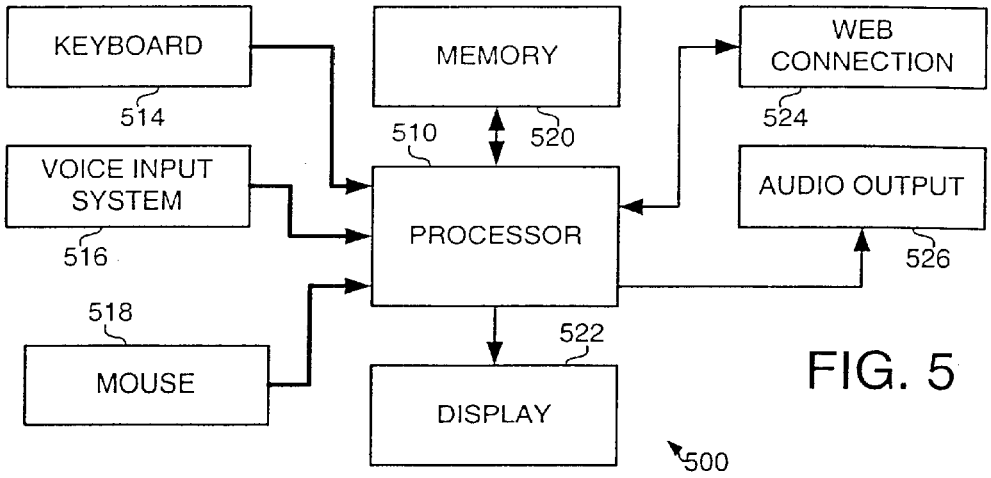
FIG. 5 illustrates a typical personal computer system according to the invention on which a sport may be practiced and instruction can take place.

An exemplary computer system 500 on which the software according to the invention may be installed to utilize the invention is shown in FIG. 5. Computer system 500 includes an electronic processor 510, a keyboard 514, a voice input system 516, a mouse 518, an electronic memory 520, a visual display device 522, a connection 524 to a worldwide electronic communication system, and an audio output 526. Each of these devices is well-known in the computer art, and therefore they will not be described in detail herein. Each may take many forms, and all forms of these devices and equivalents that presently exist and all forms and equivalents that are devised in the future are contemplated to be used as appropriate in connection with the invention. Any other peripheral electronic devices may also be combined with the computer system shown. The system of FIG. 5, for example, may be a personal computer (PC). A PC is preferably used in the Practice, Simulated, and Study modes. However, as will become clear below, it may also take on many other forms.

FIG. 6 shows a cell phone 600 which may be used as part of the system of the invention. Cell phone 600 includes: a protective housing 602 including a body portion 604 adapted to be held by a human hand, a hinge 606, and a cover portion 608; a display 620; a keyboard 630; a microphone 640; a speaker 650; an antenna 660; and internal electronics 670 which preferably includes an electronic processor, an electronic memory, and communication electronics for connecting to the Internet via electromagnetic waves. As can be seen from this description, cell phone 600, preferably includes each of the elements of the computer system of FIG. 5 except the mouse. A mouse or other device to move a cursor and select portions of the screen may optionally also be employed. Cover portion 608 and body portion 604 are rotatable about hinge 606 so that cover closes over display 620 to protect it when not in use. Keyboard 630 includes the conventional cellular phone keys, including scroll keys, such as 634, and programmable keys such as 636, which may be programmed to perform any of the functions of the button bar 201. Display 620 can display any of the screens described above. However, since the display is smaller, the screen preferably should be scrolled to display the various portions of the screen. Scrolling may be performed using scroll buttons, such as 634, or scroll icons, such as 628, on a touch sensitive screen.

Display 620 is shown displaying a portion of the set-up screen. On this screen, the various physical factors, actions, and results that are to be used may be selected. As shown, the physical factors "pin location" and "green" have been deselected and the physical factor "grade" has been selected by selecting the corresponding box, such as 624, so that an "X" is shown for a selected factor and nothing is shown for a deselected factor. The selection may be made either by tapping a touch sensitive screen or by use of a movable cursor. In this way, the user may select an abbreviated version of the system according to the invention which permits faster play and/or focusing on portions of the user's game that needs improvement.

In the cell phone system described above and any other system described herein that is connectable to other computers, the software according to the invention may be wholly or partially stored in a memory of a server computer, or may be wholly or partially stored in a local memory within the cell phone or other system.

The most preferred form of a computer system 700 according to the invention is shown in FIGS. 7–10. This is a hand-held portable computer/communication device such as a PALM™ computer, a personal digital assistant, or other hand-held computing device. Computer system 700 includes a housing 704 suitable to be held in a human hand, a display 710, a keyboard 730, a microphone 740, a speaker 150, an antenna 760, and a stylus 766. Computer 700 also preferably includes a mini-diskette device 770 (FIG. 8) for reading and writting to a miniature removable storage element, such as a mini-disc, a connector port 780 for connecting to a telephone system (FIG. 9) and corresponding internal communication electronics, such as a modem, and a coaxial input 785 for connecting the computer 700 to a docking station, and/or a keyboard, and/or a mouse.

An alternative embodiment of a computer system 800 according to the invention is shown in FIG. 11. Computer system 800 is a custom computer that is designed and programmed specifically to operate as a system according to the invention. System 800 includes: a housing 801 that includes a body portion 802, a hinge 805, and a cover portion 804; a keyboard 810; a trackball 819 or other cursor control device; a display 822; a stylus 824; an antenna 828 and associated communication electronics; and a combination speaker/microphone 838. Cover 804 and body 802 can rotate about hinge 806 to enclose and protect display 822 and keyboard 810. Keyboard 810 includes a keypad similar to a cell phone including scroll ttons 811, 812, 814, and 816 and specialized buttons 818 and 820 that enable functions similar to the functions enabled by the buttons described in connection with the button bar 201 above. These functions should be clear from reading the description of the button bar functions above, and thus will not be repeated here. Again, the display 822 is a touch sensite screen and operates as described above. Scroll icons, such as 826, can also be used to scroll the screen.

As known in the hand-held computer art, the computer 700 is preferably operated using stylus 766 to apply pressure to pressure-sensitive screen 710. The screen may be scrolled using scroll icons 712 or buttons 732 and 733. Vertical scroll icons are also available, though these are not shown for simplicity. The particular hand-held computer 700 shown includes communication electronics for accessing the Internet via a cellular communication system, hence the antenna 760. The screen 722 shown on display 710 is another portion of the set-up screen. This portion shows some of the action items in column 714, such as "shot" 716. On the screen shown, the actions "club", "grip", and "body" have been selected and the actions "shot", "club face", "stance", and "ball" have been deselected by touching the screen in the area of the corresponding box, such as 718, with stylus 766. As on the screen of FIG. 6, the other actions and items on the set-up screen are accessed by scrolling. Keyboard 730 preferably includes scroll keys 732 and 733 and programmable keys 735, 736, 737 and 738 that may be programmed with any of the functions of button bar 201. The screen 710 also preferably includes a button bar as well as other features known in the hand-held computer art, though these are not shown for simplicity.

Figure 10:
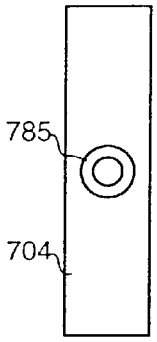
FIG. 10 is a bottom side view of the device of FIG. 7.

The screen 823 shown in FIG. 11 is another portion of the set-up screen, which portion is used to input personal comments such as the comment shown in box 156 in FIG. 1 and discussed above. Using screen 823 a comment may be entered for any action in the system. The general action is selected from a pull-down menu in box 830, and a specific one of the actions under that general action, which specific action is called a "play" herein, may be selected in box 834. For any general action or any play, a personal tip may be entered in box 836. The personal tip may be entered using a touch alphabet (not shown) as is conventional in a PALM™ or other hand-held computer, the letters associated with the numbers on keypad 810 (these letters are not shown because of space limitations) as in a cell phone, via a docking station or standard keyboard that is connectable via a port 785 as shown in FIG. 10, or via a voice recognition system. Since these tips are not entered often, the standard keyboard is the preferred method. In the screen shown, the action "shot" and the play "chip" have been selected and the personal tip "A chip shot is basically a touch shot" has been entered. In this way, a user can provide tips or hints that the user has found particularly useful or which enables the user to work on specific aspects of the user's game, and these tips will appear automatically whenever the user is about to perform the specific action with which the tip is associated.

Figure 12:
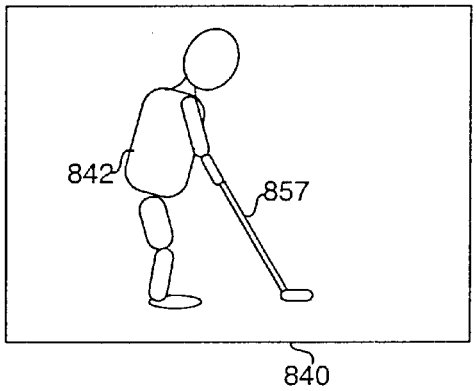
FIG. 12 illustrates a demo feature according to the invention.
Figure 13:
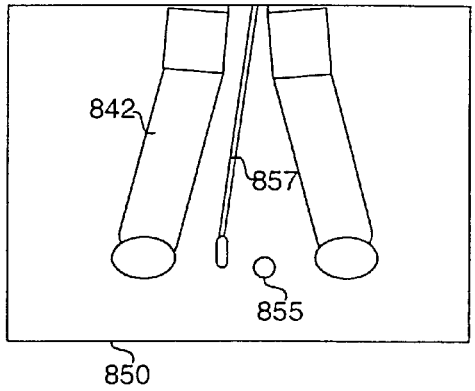
FIG. 13 illustrates a zoom feature according to the invention.

FIG. 12 illustrates a screen 840 when the "Demo" function mentioned in connection with button bar 201 above. The particular screen shows a professional golfer 842 demonstrating the proper stance for addressing the ball for a particular shot. The actual screen is a short video showing the selected expert demonstrating an action. The video may be paused at a single still "frame" as desired. Using the "Zoom" function the may zoom in on the video to better see a particular portion of the demonstration. In addition, the user may rotate the viewing angle to see the demonstration from a different direction. FIG. 13 illustrates the Zoom function. In this screen 850, the viewing angle has been rotated to view the demonstration by expert 842 from the front so that the club 857 and ball 855 may be seen from a different perspective.

Figure 14:
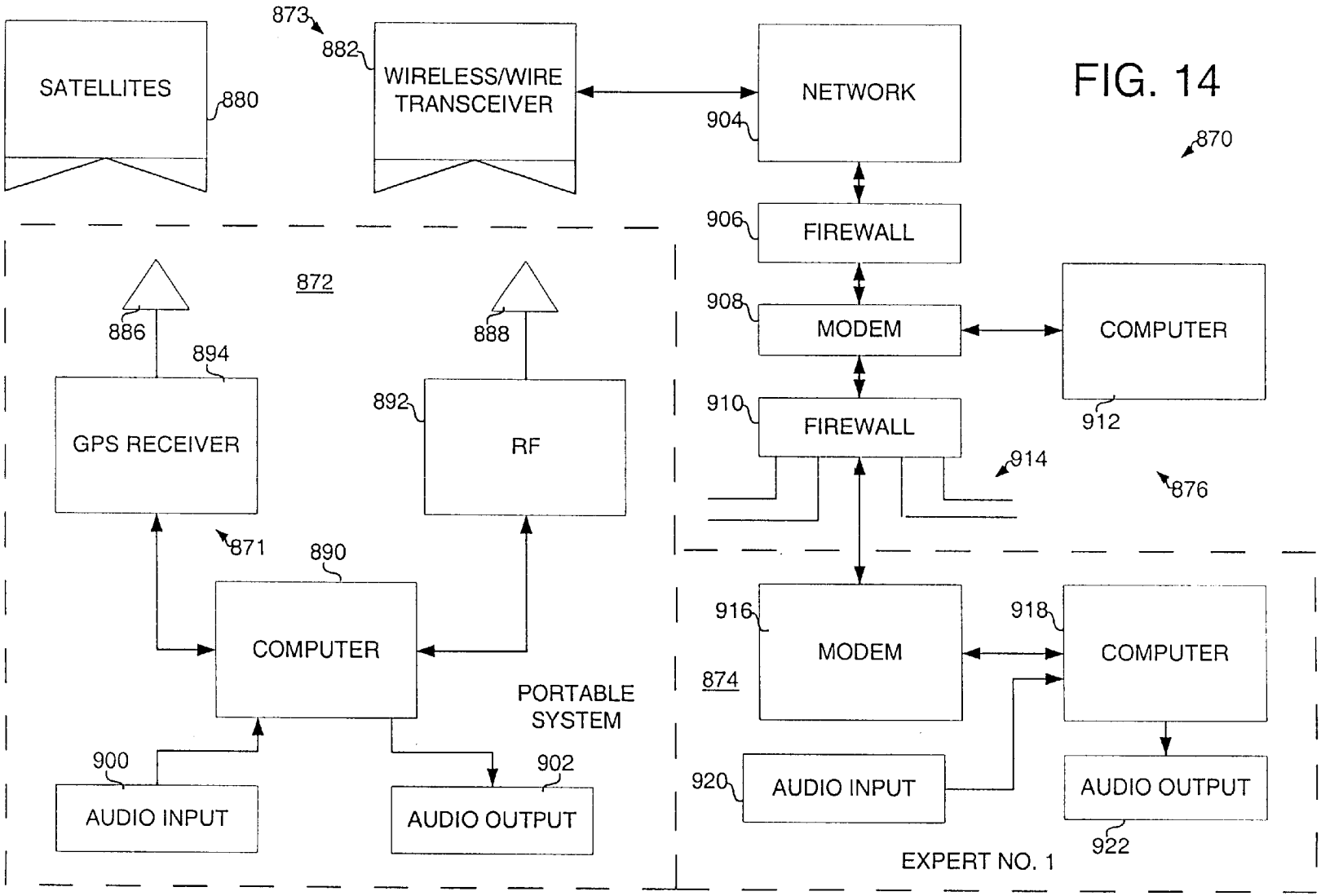
FIG. 14 illustrates a more complex computer and communication system on which a sport may be practiced and instruction can take place.

Turning to FIG. 14, another preferred embodiment of a computerized system 870 according to the invention is shown. Using system 870, a user can obtain real-time assistance from any one of a plurality of golf professionals. This system 870 also illustrates an exemplary geophysical positioning system (GPS) 871 and an exemplary electromagnetic wave communication system 873 in more detail. System 870 includes three subsystems: a subsystem 872 which is local to the user; a subsystem 874 which is local to an expert, and a subsystem 876 which is intermediary between the user system 872 and the expert system 874. Subsystem 872 may be may be any of the systems 500, 600, 700, or 800. As illustrated, it includes a computer 890, a radio frequency (RF) transceiver 892 having an antenna 888, a GPS receiver 894 having an antenna 886, an audio input 900 and an audio output 902. As known in the GPS art, a plurality of satellites 880 provides the positioning coordinates for GPS receiver 894. Subsystem 874, local to a first expert, includes a computer 918, an electronic communication device 916, which preferably is a modem 916, an audio input 920 and an audio output 922. There can be a plurality of such subsystems 874 in the system 870. Intermediary subsystem 876 includes computer 912, wireless/wire transceiver 882, a network 904, which preferably is a global network such as the Internet or a telephone communication system, a first firewall 906, a modem 908, and a second firewall 910. Lines 914 illustrate a plurality of connections via a network to a plurality of expert subsystems, such as 874. Each of the individual elements included in the system 870 is known in the respective arts and thus will not be described in detail herein. For example, a GPS system used in locating positions on a golf course is described in U.S.

Pat. No. 5,689,431 issued Nov. 18, 1997 to Rudow et al., which is hereby incorporated by reference as though fully disclosed herein. Other equivalent positioning systems may be substituted for the GPS system 871, such as the systems described in U.S. Pat. No. 5,507,485 issued Apr. 16, 1996 to Donald Fisher and U.S. Pat. No. 5,685,786 issued to Douglas P. Dudley, which are hereby incorporated by reference as though fully disclosed herein.

Using system 870, the physical factors entered as discussed in connection with FIG. 1, preferably along with the trial responses to the physical factors can be communicated from computer 890 to computer 918 where a professional golfer, i.e., the expert No. 1, can view them on the display of computer 918. Audio information can also be communicated. The pro can then provide the actions in column 180 as well as comments on screen 300 (FIG. 3). Computer 912 directs the communications between computer 890 and the experts via lines 914. The software according to the invention can also be stored on computer 912 and the various screens and other information provided as needed to computers 890 and 918. The various parts of subsystem 876 except for computer 890 and computer 918 are optional.

Figure 15:
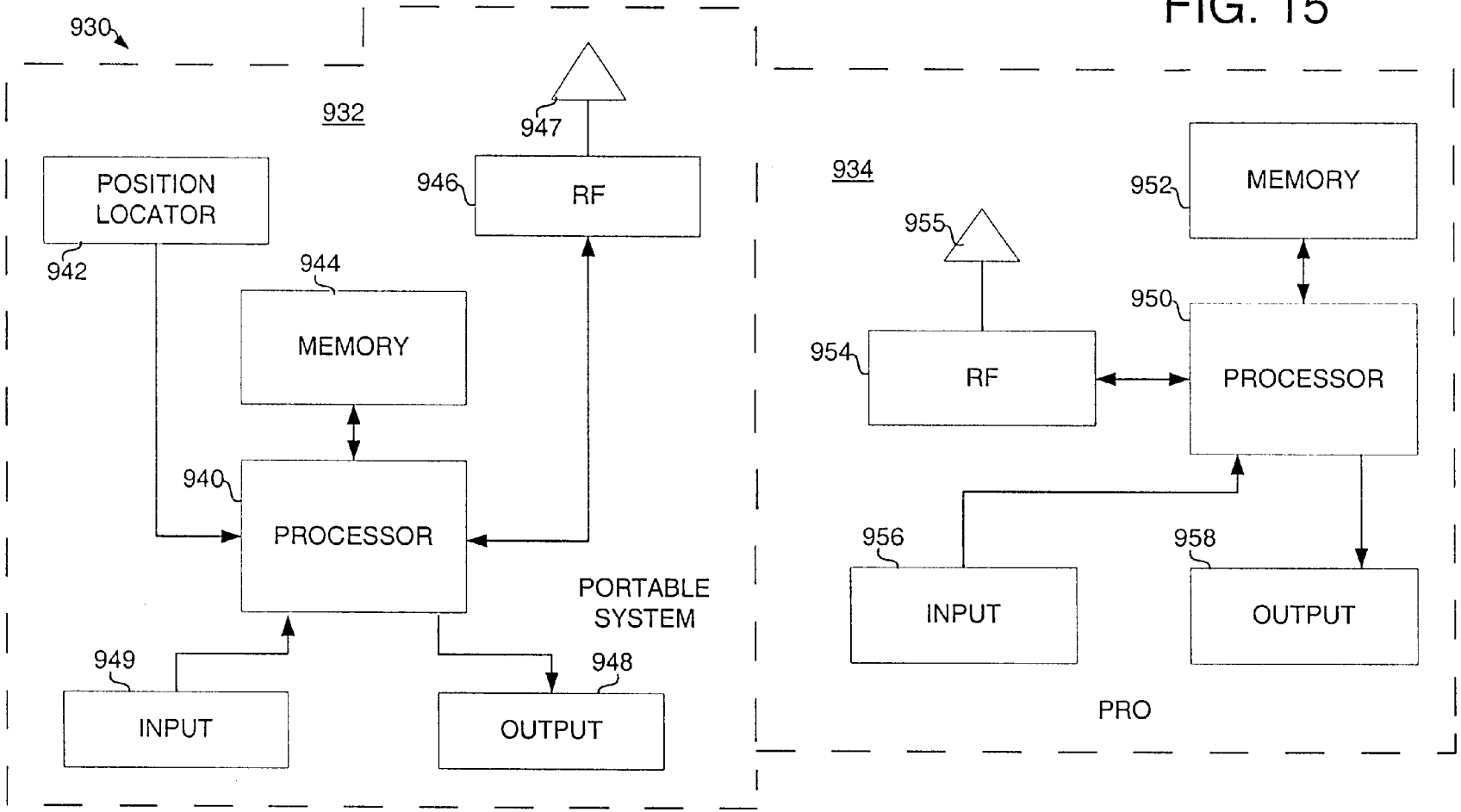
FIG. 15 illustrates an alternative computer and communication system according to the invention.

The system of FIG. 14 lends itself to a situation where the user and the experts are widely separated. FIG. 15 illustrates a system 930 that lends itself to a situation where one or more pros at a single golf course interact with users playing on the golf course. System 930 includes a preferably portable subsystem 932 local to the user and preferably fixed subsystem 934 local to the expert, i.e., the golf professional. ISubsystem 932 includes an electronic processor 940, an electronic memory 944, a position locator 942, which may be a G PS system or other electromagnetic positioning system, RF transceiver 946 having antenna 947, input system 949 and output system 948. Subsystem 934 includes electronic processor 950, electronic memory 952, RF transceiver 954 having antenna 955, input system 956, and output system 958. Using system 930, personal data of the user, the physical factors entered as discussed in connection with FIG. 1, preferably along with the trial responses to the physical factors can be communicated from processor 940 to processor 950 and a professional golfer can view them on the display 958 of system 934. Audio information can also be communicated. The pro can then provide the responses in column 180 (FIG. 1) as well as comments on screen 300 (FIG. 3). Computer 912 directs the communications between computer 890 and the experts via lines 914. The software according to the invention can also be stored in memory 944 or memory 952 or divided between them, and the various screens and other information provided as needed to computer outputs 948 and 958. Preferably, the personal data shown on screen 200 is stored in memory 952 so that it is available to the user whenever he or she plays on the particular golf course. In this way the subsystems 932 can be rented in a similar manner as golf carts or clubs may be rented to a user.

Figure 16:
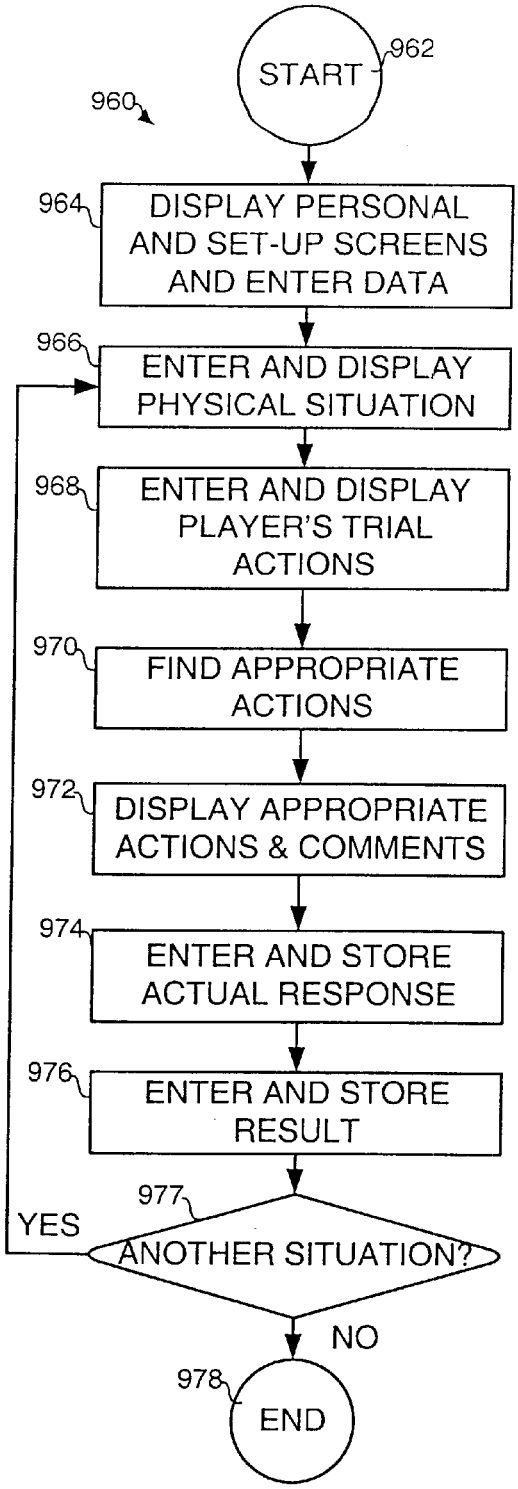
FIG. 16 is a flow chart illustrating how software control may flow in a typical version of the invention that may be used for instruction while an actual sporting event is in progress.

A flow chart 960 illustrating the flow of the software and the operation of a system according to the invention in Play mode is shown in FIG. 16. The system is initialized in step 962. In step 964 the personal data screen 200 is presented to the user, the user enters, changes, or adds to the data as desired, and the data is stored.

The set-up screen 622, 722, and 823 may also be displayed and the user customizes the system to his or her particular preferences. In step 966, the physical factor and action screen 100 is displayed and the user enters the physical factor information, and/or it is entered automatically by positioning the portable unit 600, 700, 800, 872 or 932 at the approximate position of the ball and selecting the "L" button on the button bar. In step 968 the user then enters his or her trial actions which are displayed. When the user selects the expert's name (Shortiron) at the top of column 180 (FIG. 1), the experts actions are found in step 970 and displayed in step 972. The player can then change his or her actions and select the comment button to access the comment screen 300. The user may change actions on the comment screen, which changes are saved into the current physical factor/action screen in step 974.

When the user is satisfied that the best action set has been selected, the user then plays the shot and, if desired, selects the response screen using the button bar, and enters and saves the results in step 976. In step 977, the user can then select a new physical factor/action screen either by means of the new screen (N) pull down menu or selecting the next stroke in the stroke box 106 or total stroke box 107, which returns the system to step 966. When the round is completed and the user does not want to further study the recent or other rounds or otherwise use the system, the system is exited in step 978 in which all information is stored to a non-volatile portion of memory 520 etc., such as a hard disk.

Figure 17:
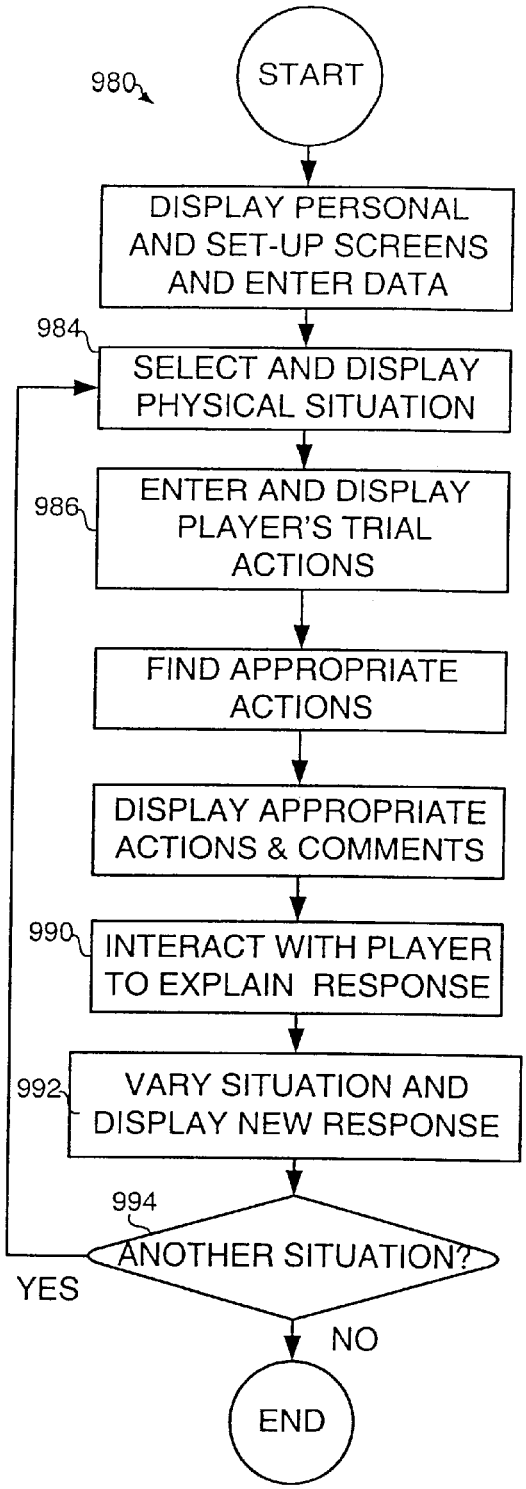
FIG. 17 is a flow chart illustrating how software control may flow in a typical version of the invention which may be used during leisure time to practice judgement required in a sport.

FIG. 17 is a flow chart 980 illustrating the flow of the software and the operation of a system according to the invention in Practice mode. The operation in the Practice Mode is the same as the operation in Play mode with the following differences. In step 984, the physical situation may be entered as it was in step 966, or a predetermined physical situation may be selected using the "N" pull-down menu. This may be one of a number of special practice screens stored in memory 520 etc., such as a screen suitable for practicing judgements related to pitching, short game, chipping, long game, bunker play, putting, etc. Or it may be a randomly selected screen. In the Practice mode, there is more emphasis on trying different actions and receiving a response from the selected pro, as indicated in step 990. To facilitate this, the comment screen icon, "C", is highlighted on the physical situation/action screen 100 and the physical factor/action screen icon, "N", is highlighted on the comment screen 300. This makes it easier to switch back and forth between the two screens. The expert icon "E", is highlighted on both screens to make it easier to review the actions and comments of different experts. Instead of entering and storing a result, the user varies the physical situation and explores the changed responses, as indicated in step 992. In step 994, instead of showing a new blank screen when a new screen is selected, the system either provides a new physical factor/action screen suitable for practicing the particular game area already selected using the "N" pull-down menu, or provides a new randomly selected physical factor/action screen, if the random screen option was selected.

Figure 18:
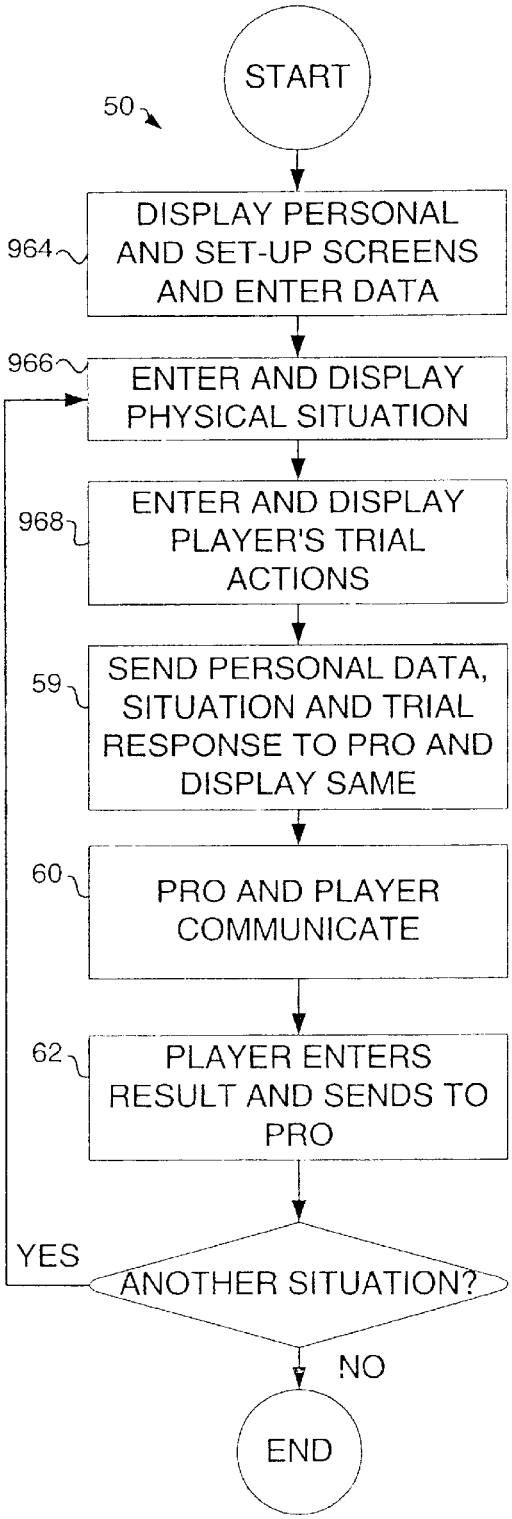
FIG. 18 is a flow chart illustrating how software control may flow in a typical version of the invention which may be used for instruction and to obtain professional assistance while playing an actual sporting event or practicing judgement required in a sport during leisure time.

Turning to FIG. 18, a flow chart 50 illustrating the flow of the software and the operation of a system according to the invention in Professional mode is shown. In this mode, the operation is the same as in the Play mode, except the emphasis is on interaction with a golf pro, which is indicated by steps 59, 60 and 62. In Professional mode, the name of the professional In FIGS. 1 and 3 is highlighted by a bright color, such as red, and by blinking, and an icon suggestive of communication with the pro appears next to the pro's name. When the physical situation and, preferably, a trial response have been entered in steps 966 and 968 and the pro's name is selected, the user's personal data, the physical situation, and trial response, if one has been entered, are sent to the pro in step 59 and displayed to the pro. If an electronic locator system is available, the location of the ball on the course can be communicated to the pro using a map location option in the "L" pull-down menu. T professional and player then interact in step 60 by the pro entering and sending back suggested actions in column 180 in screen 100 and comments using the comment screen 300. The professional and player can also talk to each other in systems in which the audio option is available. The user then plays the shot, enters the result on screen 400, and sends it to the pro for further comment and/or future reference.

Figure 19:
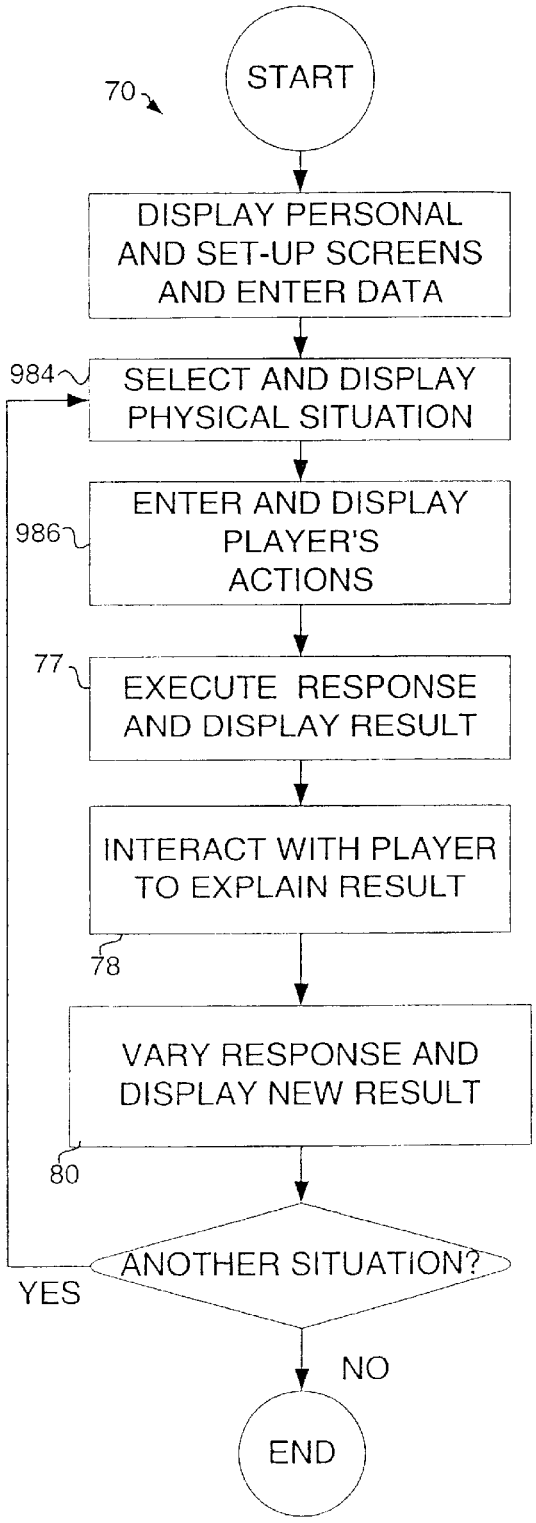
FIG. 19 is a flow chart illustrating how software control may flow in a typical version of the invention which may be used during leisure time to practice judgement required in a sport, which version also includes simulated playing of the sport.

A flow chart 70 illustrating the flow of the software and the operation of a system according to the invention in Simulated mode is shown in FIG. 19. The operation of the system in Simulated mode is the same as in the Practice mode (FIG. 17) except that a simulated golf course, ball, club and player are displayed on the computer display, such as 522, and the emphasis is on a simulated game of golf. The screens 100, 200, 300, and 400 are used as described above, but when a set of actions is decided on by the user and the results button, "R", has been selected to begin step 77, the display shows a simulation of the ball following a trajectory determined by the physical factors and actions before it shows the results screen 400. The results screen can be deactivated in set-up, and the user can rely on the pictorial display to illustrate the result.

In flow chart 70, a step 80 of varying the response and displaying a new result is also shown, since this step is more likely to be used in this mode. However, this step can be performed in other modes also, simply by reselecting the physical factor/action screen 100 and changing the parameters. In the Play mode, this permits a "gimme" shot during informal or practice play. The ability to vary the response and see a new result permits the user to explore what may result if actions are varied. If the user desires to enjoy a continuous round of simulated golf, or if a formal round of golf is being played, or simply if desired, the ability to vary the response after the results screen has been activated can be deactivated in set-up mode, and once the results screen is called up, the responses cannot be changed until a new hole is selected.

As discussed above in connection with screen 100 (FIG. 1), in connection with the flow charts of FIGS. 16–19, and in several other places herein, when a user taps on or otherwise selects the experts name at the top of column 180, or selects the "Suggested Play" phrase if no expert is installed, the system provides a suggested set of actions.

In one preferred embodiment, the system finds the appropriate suggested actions from a base data table and a table of personal adjustments. The base data table includes the appropriate response for every possible combination of physical factors. For each expert, there is a separate base data table. The table of personal adjustments includes adjustments for specific actions based on personal data input via screen 200 and personal history data input when a results screen 400 is saved.

The system also permits the integration of the base data table for any given expert and the personal data table for a given user into an integrated base/personal data table. This feature is available both during installation and set-up. This accelerates the finding of suggested actions, and is particularly useful if only one user will ordinarily be using the computer on which the system is installed.

This data table method of finding suggested plays requires a robust amount of memory. Such memory is generally present in ordinary PC's today, and is present in server computers, such as computer 912 in FIG. 14, and server memories, such as 952 in FIG. 15. However, it may not be available in portable systems, such as a hand-held computer 700 that does not have available communication electronics to access the Internet. In such systems, a more compact hierarchical decision tree program is used to provide the suggested play. A description of an exemplary decision tree program follows.

The first hierarchical level is the "Distance to Green" physical factor. That is, the program first looks at the "Distance to Green" entry, and if the ball is on the green, proceeds directly to the "Distance to Pin", "Green Speed", and "Wind" physical factors to make a selection from the base data table without considering the other physical factors, then proceeds to the personal data table to determine if any putting adjustments are required. If the ball is not on the green, then the system looks at the next hierarchical level, the Obstacle, Terrain, Lie, and Ball Position physical factors to determine if any of these require focusing the actions to escape a hazard, avoid an obstacle, or escape from difficult terrain or a bad lie. If so, then the system proceeds to a condensed "escape" base data table and personal data table to make action recommendations that ignore the other physical factors. If the Obstacle, Terrain, Lie and Ball Position physical factors are such that flexibility in making the shot is permitted but still include some difficulties, then the program proceeds to the next hierarchical level which is essentially a test loop: a first club and stroke are selected which will be most effective in escaping the physical situation and a second club and stroke are selected to permit the ball to reach the green or obtain maximum distance if the green is not reachable. The resulting trajectory is estimated for the second club and stroke, and tested to see if the club selection will not function well with any physical factor and whether the ball will encounter any obstacle. If the chance of a bad result is significant, the stroke and then the club are adjusted toward the first club and stroke, which usually means a club and stroke that will result in less distance, and the corresponding results are again tested until a stroke and club are found for which the chance of encountering a difficulty or obstacle are insignificant. If the user does not like the suggestion, he or she can select the expert or "Suggested Play" icon again and the system will repeat the loop again. The forth hierarchy is one in which there is no difficulty or obstacle that will influence club selection. In this case, the distance and direction factors, i.e., "Distance to Pin", "Distance to Green", "Grade", "Green Speed", "Ball Position" and "Wind", are used in combination with a condensed "distance and direction" base data table and personal data table to obtain a suggested set of actions.

The results in the simulated play are preferably determined from a results data table. However, this will not be described in detail, since the focus of this disclosure is not on simulating the physical aspects of a sport, but on providing coaching and practice in the mental aspects of a sport.

From the above description, a person skilled in writing software will be able to write a software program that embodies the invention, and a person skilled in computer systems will be able to provide the hardware on which the software is run.

A feature of the invention is that a plurality of discrete physical factors and discrete actions are included in the system. The term "discrete" distinguishes the system from a method of video taping a player's performance and discussing it with a professional. A video provides a holistic picture rather than plurality of discrete factors. It is important that the physical factors and actions be discrete at least in some point in the process, otherwise the judgmental steps cannot be delineated by the system or the participating professional, and, most importantly, they cannot be practiced effectively.

There has been described a novel computerized system for practicing and instructing a player in the mental aspects of an athletic sport. While the invention has been described in terms of the sport of golf, it should be understood that the description could as well have been in terms of tennis, hockey, skiing, rock climbing, or other sport. In sports in which play is continuous, such as tennis, hockey, skiing, and most aspects of climbing, the system will generally not be used during actual participation in the sport, but still can be used in practice and study. It should also be understood that the particular embodiments shown in the drawings and described within this specification are for purposes of example and should not be construed to limit the invention which will be described in the claims below. Further, it is evident that those skilled in the art may now make numerous uses and modifications of the specific embodiments described, without departing from the inventive concepts. For example, now that the advantage of providing a discrete list of physical factors and a discrete list of actions responsive to those factors has been disclosed, other methods and apparatus for doing the same can be substituted. It is also evident that a variety of computer systems may be used to implement the invention, and as computers change, so will the implementation. It is also evident that in most instances the various steps of the invention may occur in a different order; or equivalent structures and process may be substituted for the various structures and processes described; for example, a variety of different input and output devices may be used. Consequently, the invention is to be construed as embracing each and every novel feature and novel combination of features present in and/or possessed by the computer system, methods and software described.

I claim:

1. A computerized system for instructing a person in judgmental aspects of an athletic sport or for practicing said judgmental aspects, said system comprising:

an electronic storage device for storing a plurality of discrete physical factors describing a real or hypothetical situation in said athletic sport and for storing athletic sport action information regarding a plurality of different kinds of discrete actions that may be taken in response to said situation;

a processor communicating with said storage device for selecting a plurality of specific discrete actions from said action information, said specific discrete actions being automatically selected by said processor when provided with said plurality of discrete physical factors without reducing each of said factors to a numerical form; and an output device for communicating said plurality of specific discrete actions to said person.

2. A system as in claim 1 wherein at least one of said plurality of different kinds of discrete actions is selected from the group consisting of: grip; stance, swing and shot.

3. A system as in claim 2 wherein said sport is selected from the group consisting of tennis, hockey, and golf.

4. A system as in claim 1 wherein said sport is golf and said plurality of different kinds of actions include club selection and shot selection.

5. A system as in claim 1 wherein said sport is tennis.

6. A system as in claim 1 wherein said sport is hockey.

7. A system as in daim 1 wherein said sport is skiing.

8. A system as in claim 1 wherein said electronic storage device stores a plurality of groups of said specific discrete actions, each group representing a response of a different expert to one or more predetermined situations.

9. A system as in claim 8 and further including an input device for selecting one of said experts.

10. A system as in claim 1 and further including an input device for inputting said physical factors information.

11. A system as in claim 1 wherein said electronic storage device includes a visual storage portion for storing visual information showing one or more of said specific actions and said output device comprises a display for displaying said visual information.

12. A system as in claim 11 wherein said one or more specific actions are specific actions selected from the group consisting of: grip; stance, swing and shot.

13. A system as in claim 12 wherein said visual information depicts an expert illustrating said one or more specific actions.

14. A system as in claim 13 wherein said visual storage portion stores a plurality of groups of said visual information, each group representing the response of a different expert to one or more predetermined situations.

15. A system as in claim 14 and further including an input device for selecting one of said experts.

16. A system as in claim 1 wherein said electronic storage device, said processor, and said output device are part of a personal computer.

17. A system as in claim 1 wherein said electronic storage device, said processor, and said output device are part of a portable computer small enough to be held in a human hand.

18. A system as in claim 1 wherein said electronic storage device, said processor, and said output device are part of a cellular telephone.

19. A system as in claim 1 wherein said system includes a wireless Internet communication device.

20. A system as in claim 1 and further including: an input device for entering a personal tip and for associating said personal tip with an item selected from the group consisting of one or more of said physical factors, one or more of said discrete actions, and one or more of said specific discrete actions; and said output device includes an electronic device for outputting said personal tip along with said item.

21. A system as in claim 1 and further including an input device for permitting said person to input a plurality of discrete actions defining a personal response to said situation.

22. A system as in claim 21 wherein said electronic storage device also stores expert comments regarding said discrete actions, said processor further compares said selected plurality of specific discrete actions to said input plurality of specific discrete actions, and provides one or more of said expert comments when one of said selected actions does not agree with a corresponding input action.

23. A system as in claim 21 and further including an input device for inputting a plurality of discrete results corresponding to said input actions.

24. A system as in claim 23 wherein said processor uses said input discrete results in selecting said plurality of discrete actions.

25. A method for instructing a player in judgmental aspects of an athletic sport or for practicing said judgmental aspects, said system comprising:

storing in an electronic memory: physical factor information regarding a real or hypothetical situation in said athletic sport; and athletic sport action information regarding a plurality of different kinds of discrete actions that may be taken in response to said situation;

electronically selecting from said action information a plurality of specific discrete actions, said specific discrete actions being automatically electronically selected responsive to said plurality of discrete physical factors without reducing each of said factors to a numerical form; and communicating said plurality of specific discrete actions to said player.

26. A method as in claim 25 and further including inputting into said memory said physical factor information and a plurality of personal discrete actions that define a personal response to said situation.

27. A method as in claim 26 and further including the step of comparing said selected discrete actions to said personal discrete actions and providing an expert comment related to a difference between corresponding ones of said selected and personal discrete actions.

28. A method as in claim 25 wherein said electronically selecting comprises utilizing a decision tree.

29. A method as in claim 28 wherein said electronically selecting comprises utilizing a hierarchical decision tree.

30. A machine readable storage medium containing instructions for performing a method of instructing a player in judgmental aspects of a sport or a method of practicing said judgmental aspects, said method including the steps of:

storing in an electronic memory: a plurality of discrete physical factors defining a real or hypothetical situation in said sport; and sport action information regarding a plurality of actions that may be taken in response to said situation;

electronically selecting from said action information a plurality of discrete specific actions, said specific discrete actions being automatically electronically selected responsive to said plurality of discrete physical factors without reducing each of said factors to a numerical form; and communicating said plurality of specific discrete actions to said player.

31. A computerized system for instructing a person in judgmental aspects of an athletic sport or for practicing said judgmental aspects, said system comprising:

an electronic storage device for storing a plurality of discrete physical factors describing a real or hypothetical situation in said athletic sport and for storing athletic sport action information regarding a plurality of different kinds of discrete actions that may be taken in response to said situation;

a processor communicating with said storage device for selecting a plurality of specific discrete actions from said action information, said specific discrete actions being automatically selected by said processor when provided with said plurality of discrete physical factors utilizing a selection system consisting essentially of a system or systems not utilizing mathematical optimization algorithms, heuristic algorithms, neural networks, or fuzzy logic; and an output device for communicating said plurality of specific discrete actions to said person.

32. A computerized system for instructing a person in judgmental aspects of an athletic sport or for practicing said judgmental aspects, said system comprising:

an electronic storage device for storing a plurality of discrete physical factors describing a real or hypothetical situation in said athletic sport and for storing athletic sport action information regarding a plurality of different kinds of discrete actions that may be taken in response to said situation;

a processor communicating with said storage device for selecting a plurality of specific discrete actions from said action information, said specific discrete actions being automatically selected by said processor when provided with said plurality of discrete physical factors, said specific discrete actions being automatically selected from a data table; and an output device for communicating said plurality of specific discrete actions to said person.

33. A computerized system for instructing a person in judgmental aspects of an athletic sport or for practicing said judgmental aspects, said system comprising:

an electronic storage device for storing a plurality of discrete physical factors describing a real or hypothetical situation in said athletic sport and for storing athletic sport action information regarding a plurality of different kinds of discrete actions that may be taken in response to said situation;

a processor communicating with said storage device for selecting a plurality of specific discrete actions from said action information, said specific discrete actions being automatically selected by said processor when provided with said plurality of discrete physical factors, said specific discrete actions being automatically selected utilizing a decision tree; and an output device for communicating said plurality of specific discrete actions to said person.

34. A computerized system as in claim 33 wherein said decision tree is a hierarchical decision tree.

35. A method for instructing a player in judgmental aspects of an athletic sport or for practicing said judgmental aspects, said system comprising:

storing in an electronic memory: physical factor information regarding a real or hypothetical situation in said athletic sport; and athletic sport action information regarding a plurality of different kinds of discrete actions that may be taken in response to said situation;

electronically selecting from said action information a plurality of specific discrete actions, said specific discrete actions being automatically electronically selected responsive to said plurality of discrete physical factors utilizing a process consisting essentially of a system or systems not utilizing mathematical optimization algorithms, heuristic algorithms, neural networks, or fuzzy logic; and communicating said plurality of specific discrete actions to said player.

36. A method for instructing a player in judgmental aspects of an athletic sport or for practicing said judgmental aspects, said system comprising:

storing in an electronic memory: physical factor information regarding a real or hypothetical situation in said athletic sport; and athletic sport action information regarding a plurality of different kinds of discrete actions that may be taken in response to said situation;

electronically selecting from said action information a plurality of specific discrete actions, said specific discrete actions being automatically electronically selected from a data table responsive to said plurality of discrete physical factors; and communicating said plurality of specific discrete actions to said player.

37. A method for instructing a player in judgmental aspects of an athletic sport or for practicing said judgmental aspects, said system comprising:

storing in an electronic memory, physical factor information regarding a real or hypothetical situation in said athletic sport; and athletic sport action information regarding a plurality of different kinds of discrete actions that may be taken in response to said situation;

electronically selecting from said action information a plurality of specific discrete actions, said specific discrete actions being automatically electronically selected responsive to said plurality of discrete physical factors and utilizing a decision tree; and communicating said plurality of specific discrete actions to said player.

38. A method as in claim 37 wherein said electronically selecting comprises utilizing a hierarchical decision tree.

* * * * *